US005998713A

United States Patent [19]

Herin

[11] Patent Number: 5,998,713

[45] Date of Patent: Dec. 7, 1999

[54] TUNING PEG

[76] Inventor: John C Herin, 2113 Park St., Columbia, S.C. 29201

[21] Appl. No.: 09/249,279

[22] Filed: Feb. 11, 1999

Related U.S. Application Data

[60] Provisional application No. 60/074,545, Feb. 12, 1998.

[51] Int. Cl.[6] ..... G10D 3/14

[52] U.S. Cl. ..... 84/305; 84/304

[58] Field of Search ..... 84/297 R, 304, 84/305, 306

[56] References Cited

U.S. PATENT DOCUMENTS

| | | | |
|---|---|---|---|
| 316,658 | 4/1885 | Prenzel | 84/305 |
| 360,186 | 3/1887 | White | 84/306 |
| 361,500 | 4/1887 | Gardner | 84/306 |
| 1,422,738 | 7/1922 | Caspari | 84/305 |
| 1,443,486 | 1/1923 | Lindstrom | 84/305 |
| 1,506,373 | 8/1924 | Kremp | 84/306 |
| 1,554,772 | 9/1925 | Weymann | 84/306 |
| 1,604,367 | 10/1926 | Page | 84/306 |
| 1,669,824 | 5/1928 | Grover | 84/306 |
| 1,672,348 | 6/1928 | Sharpe | 84/304 |
| 1,710,802 | 4/1929 | Page | 84/306 |
| 1,802,937 | 4/1931 | Bertram | 84/306 |
| 3,023,658 | 3/1962 | Gusey | 84/306 |
| 3,431,807 | 3/1969 | Thompson | 84/306 |
| 3,726,172 | 4/1973 | Sorkin | 84/304 |
| 4,026,182 | 5/1977 | Gilbrech | 84/304 |
| 4,077,295 | 3/1978 | Zapp | 84/304 |
| 4,191,086 | 3/1980 | Spercel | 84/306 |
| 5,272,953 | 12/1993 | Koch | 84/458 |
| 5,620,389 | 4/1997 | Sato | 475/249 |
| 5,767,427 | 6/1998 | Corso | 84/306 |

FOREIGN PATENT DOCUMENTS

| | | |
|---|---|---|
| 16714 | 6/1904 | Austria . |
| 346335 | 12/1921 | Germany . |
| 240535 | 10/1925 | United Kingdom . |

*Primary Examiner*—Robert E. Nappi
*Assistant Examiner*—Wesley Scott Ashton
*Attorney, Agent, or Firm*—Michael A Mann; Michael E Wever; Nexsen Pruet Jacobs & Pollard LLP

[57] ABSTRACT

A tuning peg incorporates an internal planetary gear reduction mechanism so that a stringed instrument, such as the cello, violin or viola, can be easily and precisely tuned. In order to change the pitch of a string, the head of each peg is rotated which in turn rotates the carrier that holds the string. Turning the head drives a toothed input shaft that runs the entire length of peg. The input shaft engages and rotates a plurality of planetary gears that engage a ring gear that is affixed to the peg box. Thus, rotation of the head rotates the carrier that changes the tension on the string, but the number of turns of the head required to rotate the carrier once is a multiple of one so that the carrier can be rotated more easily and the instrument can be tuned more precisely.

6 Claims, 8 Drawing Sheets

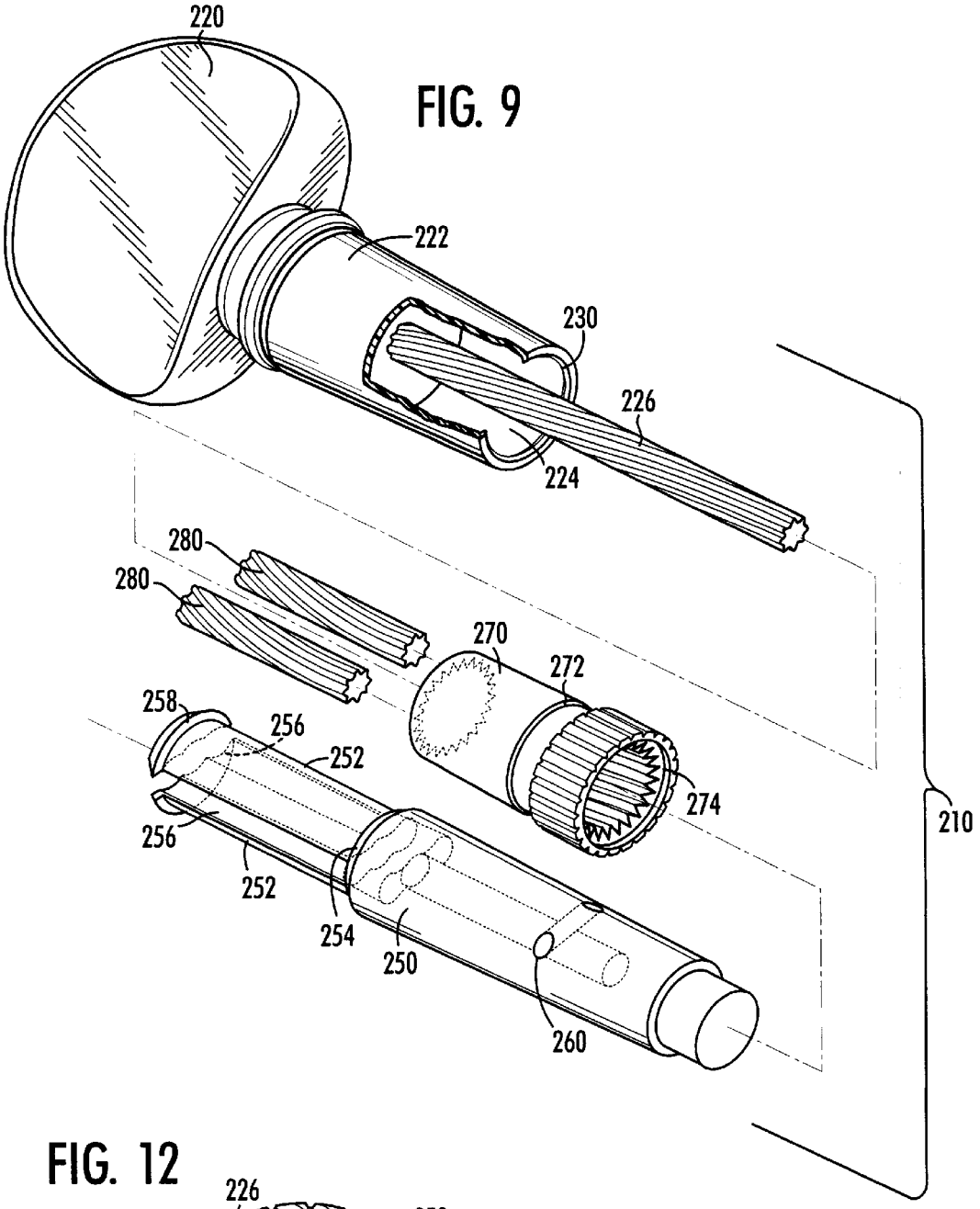
FIG. 9
FIG. 12
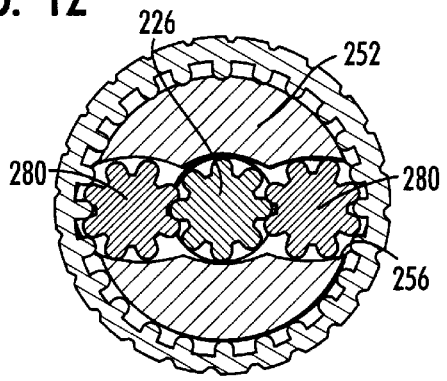

TUNING PEG

PRIORITY CLAIM

This application claims the benefit of U.S. Provisional Application No. 60/074,545, filed Feb. 12, 1998.

FIELD OF THE INVENTION

The present invention relates to a device for tuning stringed instruments. In particular, the present invention relates to a tuning peg containing a gear reduction system so a stringed instrument, such as the cello, violin or viola, can be easily and precisely tuned.

BACKGROUND OF THE INVENTION

Tuning pegs have been used in stringed instruments for hundreds of years. Traditionally, tuning pegs comprise a tapered piece of wood that is in frictional engagement with a tapered hole in the peg box of the stringed instrument. The string is secured at one end to the instrument and at the opposing end to the peg. Rotating the peg changes the tension on the string.

In order to maintain string tension, friction between the hole and the peg is necessary; however, the friction also creates difficulty in tuning the instrument because it must be overcome to change tension. For the larger strings that produce lower musical notes especially, accurate tuning can be difficult and time consuming.

In order to tune a stringed instrument, sufficient torque must be applied to overcome not only the friction between the hole and peg but also the friction of the string at the nut. In applying such torque, it is easy to turn the peg too far thereby requiring repeated attempts in tuning the string to the desired pitch; clearly, fine tuning a stringed instrument is a painstaking task. Moreover, exerting fine motor control with strength to tune the instrument is difficult for young students. In most cases, the teacher must spend considerable time in class tuning instruments for the students since they have difficulty tuning the instruments accurately by themselves.

Previous attempts to improve the tuning peg have been unsatisfactory. These pegs are often complex devices with numerous parts. One attempt at solving this problem, for example, was a six-piece tuning peg with a member fixed in a peg box hole and having a screw extending from the head through the member for creating the clamping force to maintain string tension; thus, to tune the instrument, the screw must be loosened. These pegs have not overcome the difficulty of accurately tuning large strings. Moreover, these pegs require musicians to carry screwdrivers if they want to tune their instruments or replace their strings. Therefore, there is a need for a tuning peg that facilitates the tuning of stringed instruments by reducing the torque required to turn the peg, especially a device that can be back-fitted to existing instruments having traditional pegs.

SUMMARY OF THE INVENTION

According to its major aspects and broadly stated the present invention is a device for tuning stringed instruments. In particular, the present invention relates to a tuning peg containing a reduction gear system so that a stringed instrument, such as the cello, violin or viola, fitted with the improved peg can be easily and precisely tuned. In order to change the pitch of a string, the head of the peg is rotated which ultimately rotates the carrier that holds the string. The peg has an internal system configured for gear reduction so that the head must be turned multiple times to cause the carrier to rotate one time. Thus, the musician can tune his or her instrument very precisely.

The head drives a toothed input shaft that runs the entire length of the peg. The input shaft extends through the carrier and engages the teeth of a plurality of wide-faced planetary gears held within the carrier such that rotation of the input shaft drives the planetary gears. A ring gear encases a portion of carrier and encircles the planetary gears so that the rotation of the input shaft is ultimately translated into rotation of the carrier through the planetary gears and fixed ring gear, to tighten or loosen the string.

A major feature of the present invention is the gear reduction system integrated into the peg. Because of its mechanical advantage, gear reduction allows the head to be turned more easily since the string is rotated only a fraction of a turn for each rotation of head. Effort is thus reduced. The advantage derived from this feature is the reduction in the level of effort required to tune a string so that even a young student can exert sufficient torque to tune a stringed instrument. Moreover, the control over the pitch of the string as it is being tightened or loosened is much finer, allowing more accurate, predictable tuning. Additionally, gear reduction eliminates the need for auxiliary string adjusters that have become prevalent with stringed instruments.

An important advantage of the present invention is the simplicity of design. The ability of the peg to substantially reduce tuning effort while still comprising very few parts, reduces manufacturing costs. Moreover, the low number of parts required by the design minimizes the potential for mechanical failure of the peg. The large face width of the gear teeth allows the carrier to tension even the heaviest string gauges.

Another major feature of the present invention that traditional instruments can be back-fitted without modification or damage to the peg box. Although other devices may have tuning advantages similar to the present invention, they do not have the appearance of traditional tuning pegs. The gear reduction mechanism is incorporated within the peg so that the outer envelope of the peg is substantially similar to a traditional tuning peg.

Still another important advantage in an alternative embodiment of the present invention is the ability to use the peg in any one of the peg holes of the instrument. Since the pegbox is normally shaped in the form of a trapezoid, tuning pegs are normally required to be of varying lengths; however, in the alternative embodiment the tuning peg can telescope to fit peg boxes of differing sizes.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 9 is a cut-away, exploded, partially cut-away, perspective view of a tuning peg, according to a second alternative embodiment of the present invention;

FIG. 12 is a front cross-sectional view along line 12—12 in FIG. 11 of a tuning peg, according to a second alternative embodiment of the present invention;

DETAILED DESCRIPTION OF PREFERRED EMBODIMENTS

Referring now to the figures, the present invention is a peg for tuning a stringed instrument 2. This embodiment is intended to be a replacement for "Caspari"-type pegs. A first alternative embodiment, to be described below, is intended for new instruments and valuable instruments. Second and third alternative embodiments, also described below, are also intended to be replacements for conventional pegs.

Figure 1:
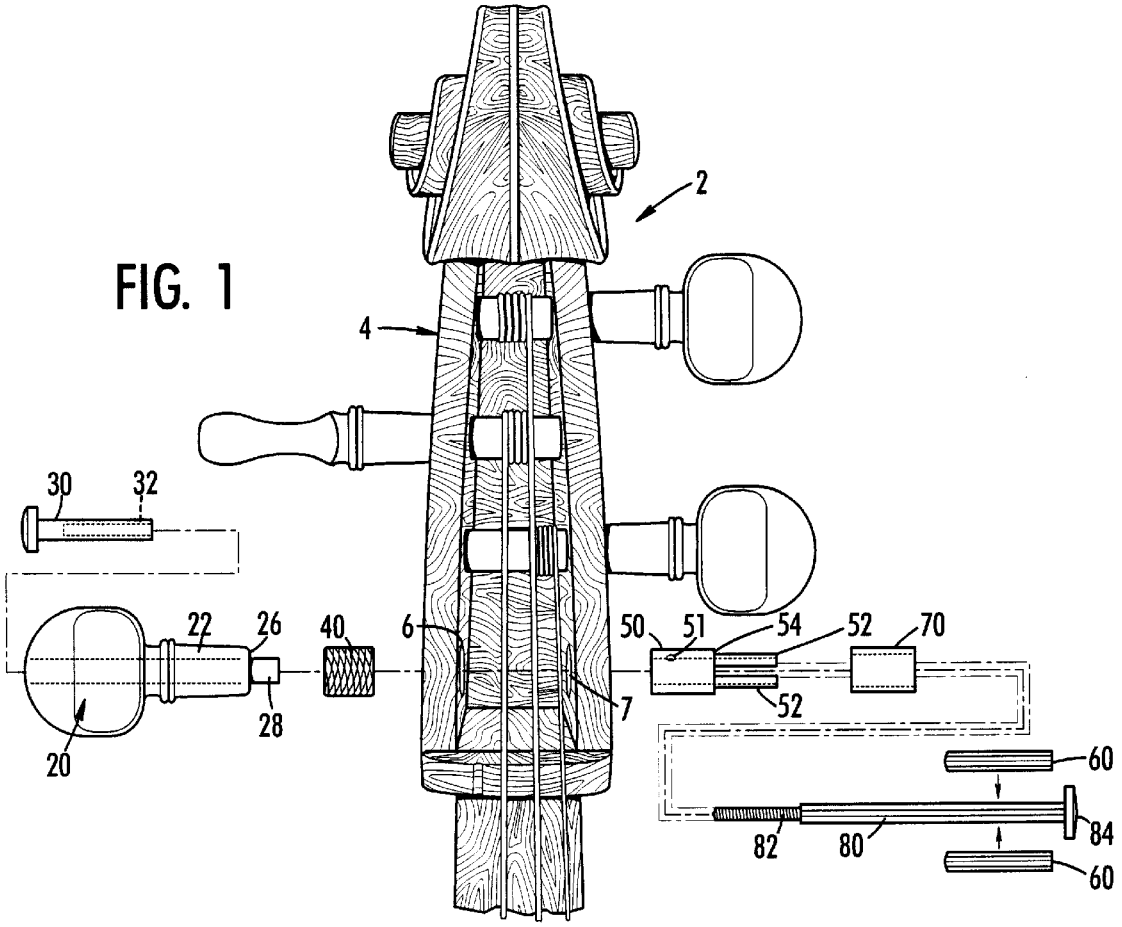
FIG. 1 is a partially exploded view of the scoll of a stringed instrument having four tuning pegs, according to a preferred embodiment of the present invention.
Figure 2:
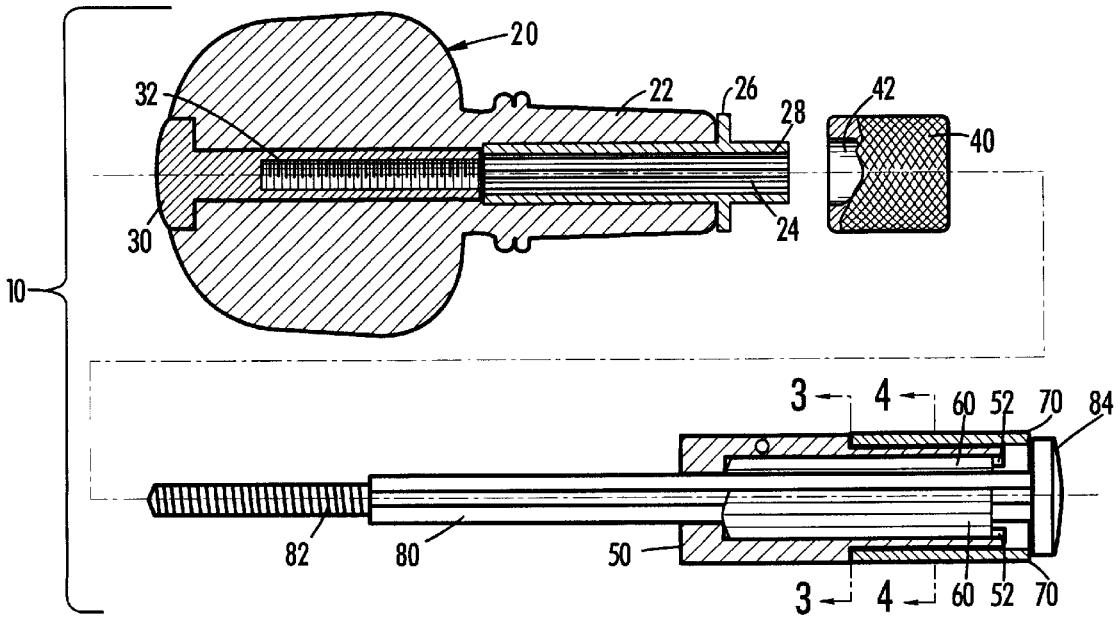
FIG. 2 is an exploded, cross-sectional, side view of a tuning peg, according to a preferred embodiment of the present invention.

The peg, generally referred to by reference number 10, mainly comprises, in a preferred embodiment, a head 20, an internally threaded bolt 30, a bushing 40, a carrier 50, at least one planetary gear 60, a ring gear 70 and an input shaft 80. For purposes of referring to the drawings, the left side of peg 10, as illustrated in FIG. 1, corresponds to the side of peg 10 closest to head 20 while the right side of peg 10 refers to the side that corresponds to cap 84.

Head 20 is the part of peg 10 that a user would grasp between thumb and forefinger in order to rotate peg 10 when changing the pitch of a string. Head 20 is preferably shaped to look like a traditional tuning peg. Head 20 is in the shape of a rounded rectangle with its major front and back surfaces concave to receive the pad of the user's thumb. A shank 22 that is cylindrical in shape protrudes from head 20. Shank 22 is preferably tapered slightly with an internally splined cylindrical flange 28 that has a substantially reduced diameter to form a shoulder 26. The diameter of shank 22 at shoulder 26 is preferably approximately the same as the outer diameter of bushing 40. Internally splined flange 28 is fixed relative to and within shank 22 so as not to rotate relative to shank 22. The outer diameter of internally splined flange 28 is preferably equal to that of the hole 42 in bushing 40. In the preferred embodiment, a hole 24 extends through head 20, shank 22 and internally splined flange 28 of sufficient diameter to accommodate bolt 30 and input shaft 80. Although head 20 and shank 22 are preferably made of wood or hard plastic, each could be made of any other dimensionally stable, durable material.

Figure 5:
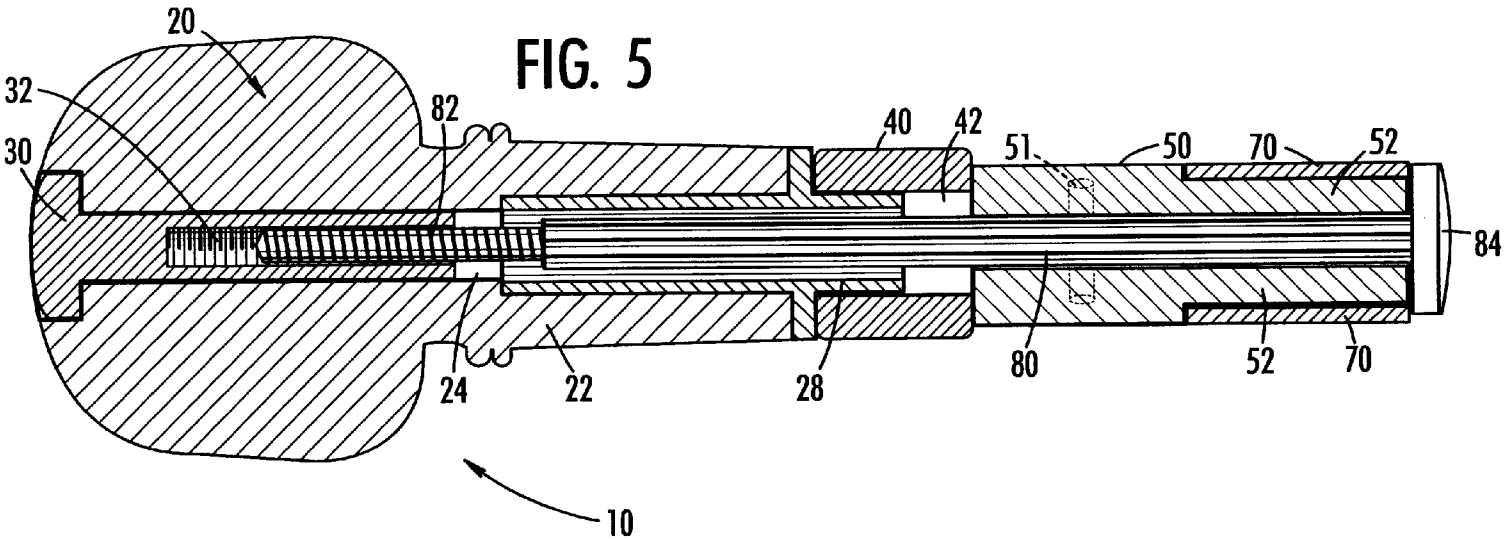
FIG. 5 is a side cross-sectional view of a tuning peg, according to a preferred embodiment of the present invention.

As illustrated in FIG. 5, a bolt 30 is located inside hole 24 on left side of head 20 while internally splined flange 28 is positioned inside bushing 40. Bolt 30 has a cavity 32 formed therein that is internally threaded such that the threads are complimentary to the threads on the threaded end 82 of input shaft 80, with cavity 32 having a sufficiently large diameter to receive threaded end 82 of input shaft 80. Bushing 40 is preferably cylindrical in shape with a hole 42 of sufficient diameter to accommodate internally splined flange 28. Outer surface of bushing 40 is preferably knurled to grip large peg box hole 6. Bushing 40 is also preferably fixed in large peg box hole 6 using an adhesive or the like and made of metal, epoxy, wood, or hard plastic, but any other like material could be substituted without detrimentally affecting head 20.

Figure 4:
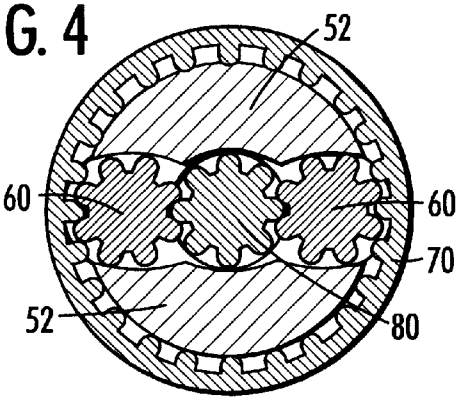
FIG. 4 is a front cross-sectional view along line 4 in FIG. 2 of a tuning peg, according to a preferred embodiment of the present invention.
Figure 3:
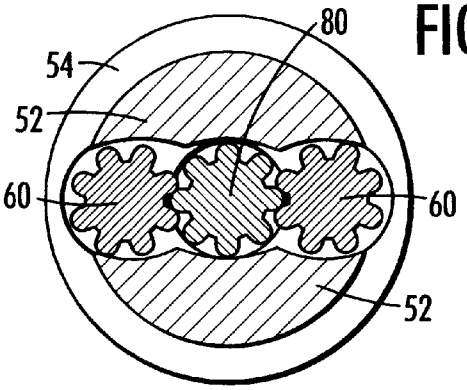
FIG. 3 is a front cross-sectional view along line 3 in FIG. 2 of a tuning peg, according to a preferred embodiment of the present invention.
Figure 6:
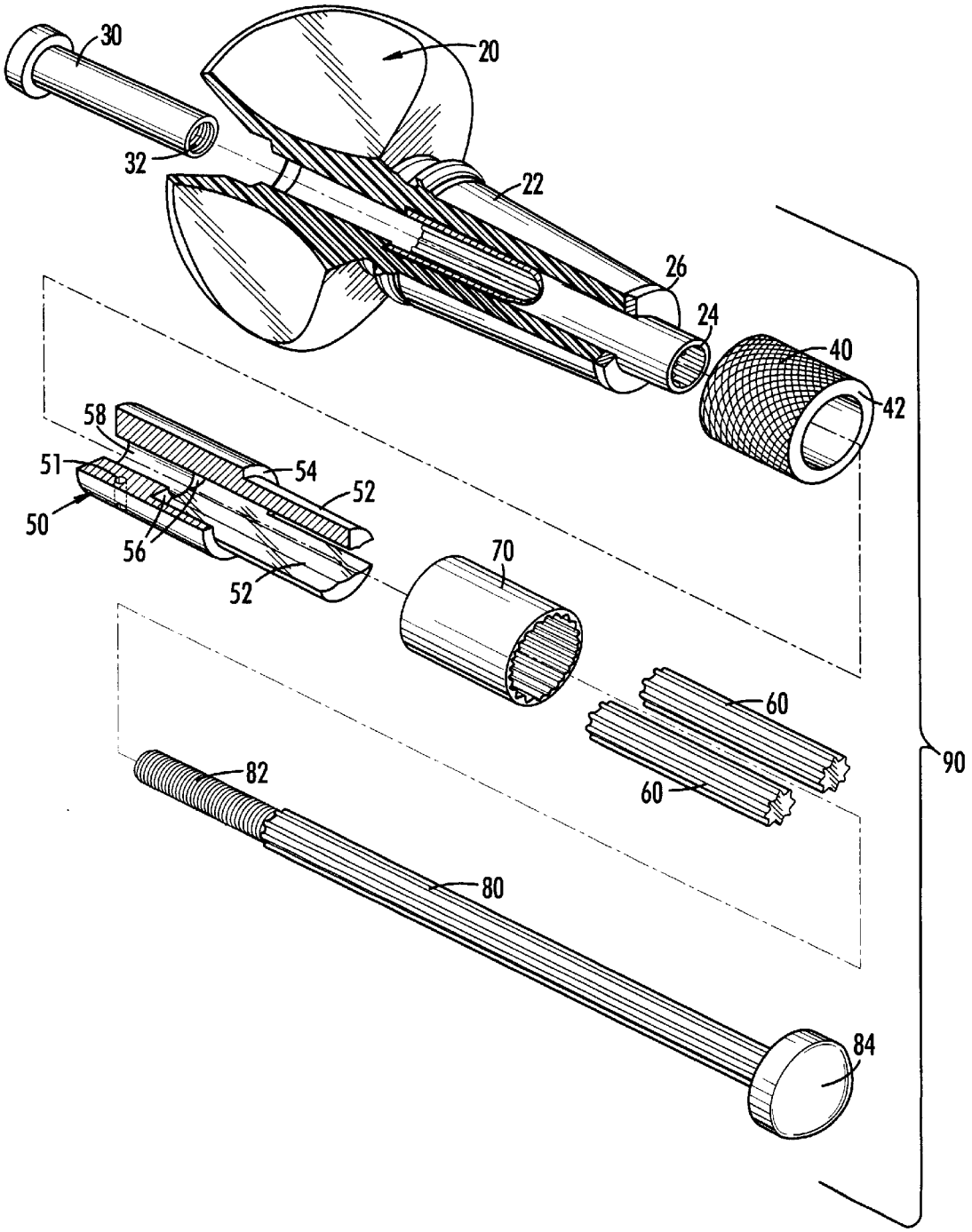
FIG. 6 is a cut-away, exploded, partially cut-away, perspective view of a tuning peg, according to a preferred embodiment of the present invention.

Carrier 50 abuts bushing 40 and holds planetary gears 60 in spaced relation. Carrier 50 is cylindrical in shape on the left end with preferably a pair of prongs 52 protruding from the shoulder 54. As is best illustrated in FIG. 6, carrier 50 contains an aperture 58 of sufficient diameter to accommodate input shaft 80. At the leftmost end of carrier 50, aperture 58 is preferably only of sufficient size to accommodate input shaft 80 while a portion of carrier 50 to the right of inner shoulder 56 must be of sufficient size to accommodate not only input shaft 80, but also preferably a pair of planetary gears 60. As seen in FIG. 3, planetary gears 60 rest on inner shoulders 56 between prongs 52. The distance between prongs 52 is preferably of sufficient size to accommodate planetary gears 60 and input shaft. The diameters of prongs 52 are offset from the cylindrical portion of carrier 50 by a distance equal to the width of shoulder 54. The offset distance is preferably sufficient so that outer diameter of ring gear is flush with cylindrical portion of carrier 50 when encasing prongs 52. As illustrated in FIG. 4, the width of prongs 52 is preferably less than the combined width of the planetary gears 60 and input shaft 80 such that planetary gears 60 can engage ring gear 70. Inner shoulders 56 are preferably positioned a distance left of the end of prongs 52 such that planetary gears 60 are flush with the end of prongs 52. Carrier 50 also contains a hole 51 for receiving a string therethrough. The diameter of string hole 51 is preferably sufficient to accommodate the string of a stringed instrument 2. The string hole 51 is located in carrier 50 in such a way so as to not obstruct any of its inner workings. Although carrier 50 is preferably made of brass, any other material such as aluminum, steel, ceramic, hardened plastic or any other material with sufficient rigidity to support rotation of planetary gears 60 will be suitable.

Planetary gears 60 rest on inner shoulders 56 of carrier 50 and are driven by input shaft 80. Planetary gears 60 are preferably the same pitch and diameter as input shaft 80 and have complementary teeth to both input shaft 80 and ring gear 70. Although peg 20 preferably contains two planetary gears with eight teeth, many different combinations of planetary gears with various numbers of teeth could be used depending upon the desired gear ratio. Although planetary gears 60 are preferably made of carbon steel, any material with sufficient rigidity such as hard plastic, brass, steel, and other metals and metal alloys could be used.

Ring gear 70 encases prongs 52 of carrier 50 and abuts shoulder 54 on carrier 50. Ring gear 70 preferably has an outside diameter equal to that of carrier 50 so that the outer surface of ring gear 70 is flush with the outer surface of carrier 50 when placed over prongs 52. Ring gear 70 has complementary teeth to planetary gears 60 and is preferably fixed within a small peg box hole 7 when in use. Although ring gear could have different numbers of teeth depending on the desired gear ratio, ring gear preferably contains 24 teeth.

The left end of input shaft 80 has a threaded portion 82, while the rightmost end has a cap 84. Input shaft 80 is of sufficient length to extend through carrier 50, bushing 40, internally splined flange 28, shank 22, and head 20 to be secured to internally threaded bolt 30. Cap 84 is cylindrical in shape with a diameter preferably equal to that of carrier 50. Input shaft preferably has the same diameter as planetary gears 60 and the same number of teeth. Since load is born by the apexes or tips of teeth of planetary gears, the need for additional shafts is eliminated.

In use, the musician turns head 20 which in turn rotates input shaft 80. As illustrated in FIG. 4, rotation of input shaft 80 drives planetary gears 60 which in turn engage fixed ring gear 70. As planetary gears 60 are driven and engage fixed ring gear 70, prongs 52 are rotated by gear teeth which in turn rotates carrier 50 and the string is thus wound around it. Using this gear network, the musician is required to turn head 20 multiple times for carrier 50 to rotate fully once which allows for easier and more precise control of tuning.

Figure 7:
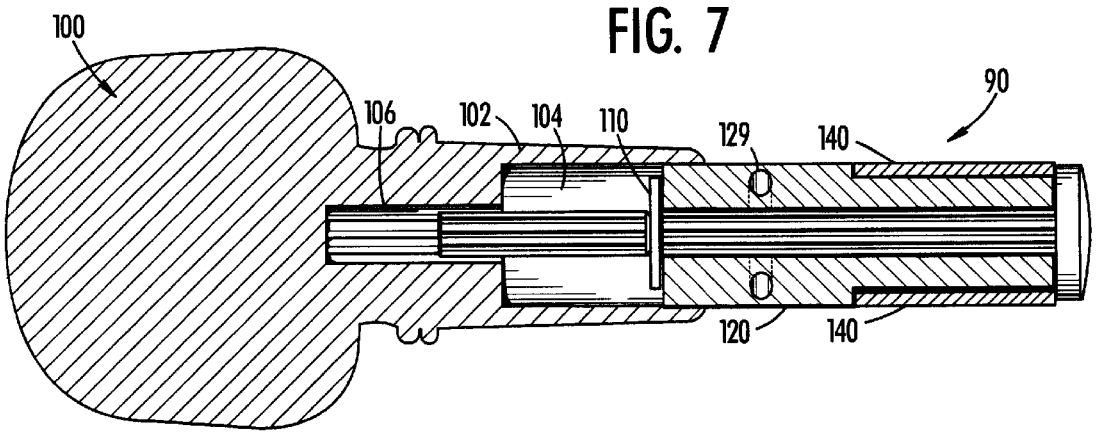
FIG. 7 is a side cross-sectional view of a tuning peg, according to a first alternative embodiment of the present invention.
Figure 8:
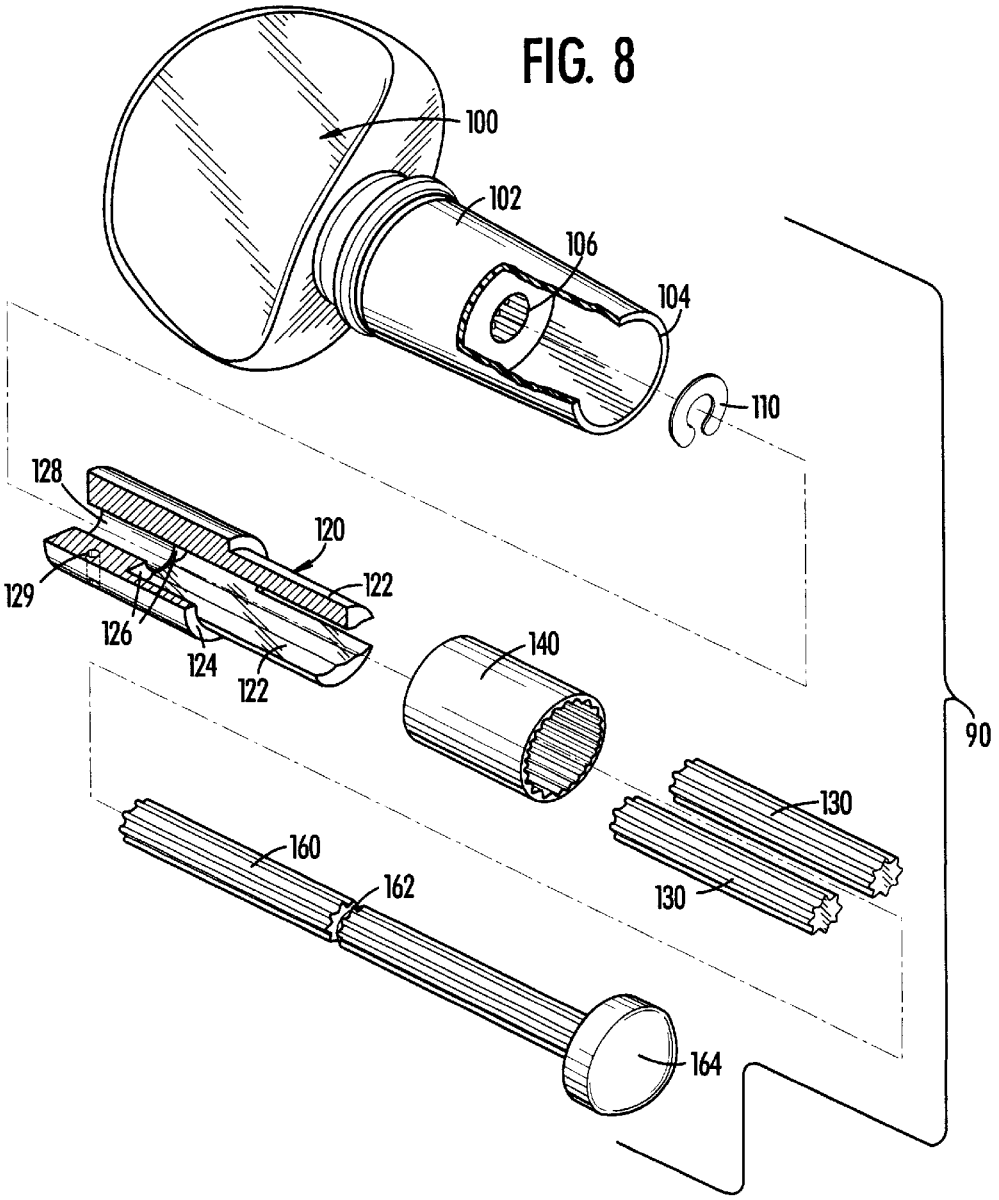
FIG. 8 is a cut-away, exploded, partially cut-away, perspective view of a tuning peg, according to a first alternative embodiment of the present invention.
Figure 10:
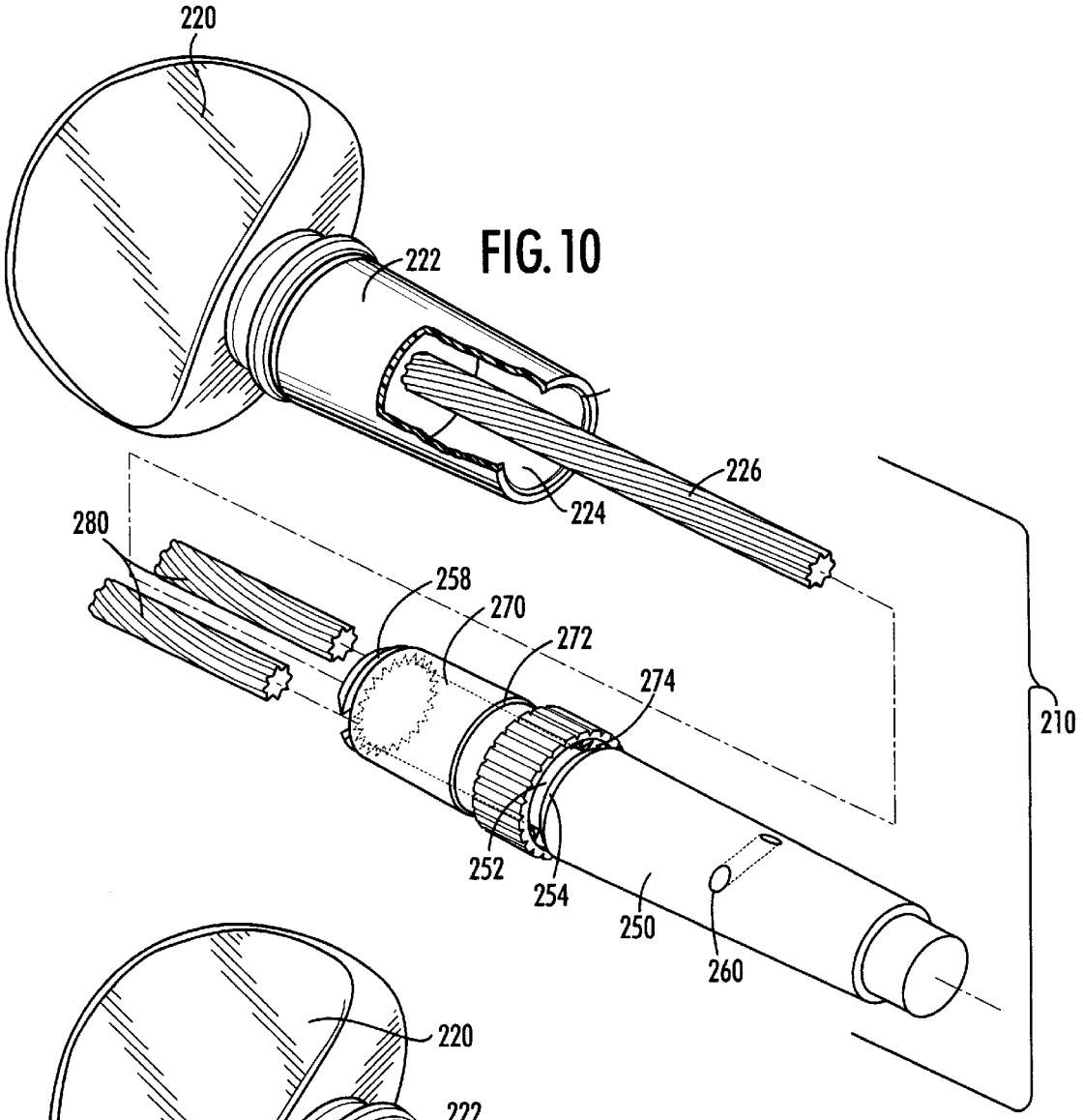
FIG. 10 is a cut-away, exploded, partially cut-away, perspective view of a tuning peg with the ring gear carried by the carrier, according to a second alternative embodiment of the present invention.

A first alternative embodiment is illustrated in FIGS. 7–8. The alternative embodiment does not require bolt or hole through head and may be preferred for fine instruments in which the bolt would detract from what would otherwise be a traditional appearance. Also, in the first alternative embodiment the overall length of peg 90 may be adjusted telescopically to conform to the varying widths of peg box 4.

Head 100 is the part of peg 90 that a user rotates to change the pitch of a string. Head 100 is preferably of similar shape as the head on a traditional tuning peg. Head 100 is a rounded rectangle in shape with a concave surface. A shank 102 that is cylindrical in shape protrudes from head 100. The tapered diameter of shank 102 is preferably approximately the same as the tapered diameter of peg box hole 6 to enable a friction fit. As seen in FIG. 8, shank 102 has an outer cavity 104 and an inner cavity 106. The diameter of outer cavity 104 is preferably of sufficient size to accommodate carrier 120 while the diameter of inner cavity 106 is of sufficient size to receive input shaft 160. Inner cavity 106 is internally splined such that splines are complementary to the teeth of input shaft 160. Although head 100 and shank 102 are preferably made of hard plastic, both could be made of wood, aluminum, phenolic, brass, or any other like material.

As illustrated in FIG. 7, a concave snap ring 110 is held by notch 162 on input shaft 160 to abut carrier 120 for preventing undue vibration. Although a snap ring 110 is used to keep carrier 120 and ring gear 140 from sliding, any stop or other device capable of eliminating sliding could easily be substituted for snap ring 110. Snap ring 110 is preferably made of steel but could be made of hard plastic, aluminum, brass or any like material.

Carrier 120 abuts snap ring 110, holds planetary gears 130 and is preferably contained within shank 102. Carrier 120 is cylindrical in shape on the left end with preferably a pair of prongs 122 protruding the shoulder 124. Carrier 120 contains an aperture 128 of sufficient diameter to accommodate input shaft 160. At the leftmost end of carrier 120, aperture 128 is preferably only of sufficient diameter to accommodate input shaft 160 while a portion of aperture 128 to the right of inner shoulder 126 must be of sufficient size to accommodate not only input shaft 160, but also preferably a pair of planetary gears 130. Planetary gears 130 rest on inner shoulders 126 between prongs 122. The distance between prongs 122 is preferably of sufficient size to accommodate planetary gears 130 and input shaft 160 without undue backlash. Outer diameter of prongs 122 is offset from the cylindrical portion of carrier 120 a distance of shoulder 124. The offset distance is preferably sufficient so that ring gear 140 is flush with cylindrical portion of carrier 120 when encasing prongs 122. The width of prongs 122 is preferably less than the combined width of the planetary gears 130 and input shaft 160 so that planetary gears 130 can engage ring gear 140. Inner shoulders 126 are preferably positioned a distance left of the end of prongs 122 such that planetary gears 130 are flush with the end of prongs 122. Carrier 120 also contains a string hole 129 for holding a string. The diameter of string hole 129 is preferably sufficient to accommodate the string of a stringed instrument 2 while the string hole 129 is placed in carrier 120 so as to not obstruct any inner workings. Although carrier 120 is preferably made of brass, any other material such as aluminum, steel, hardened plastic or any other material with sufficient rigidity to support rotation of planetary gears 130.

Planetary gears 130 rest on inner shoulders 126 of carrier 120 and are driven by input shaft 160. Planetary gears 130 are preferably the same diameter as input shaft 160 and have complementary teeth to both input shaft 160 and ring gear 140. Although peg 90 preferably contains two planetary gears 130 with eight teeth, many different combinations of planetary gears 130 with various numbers of teeth could be used. Although planetary gears 130 are preferably made of carbon steel, any material with sufficient rigidity such as hard plastic, brass, aluminum, could be used.

Ring gear 140 encases prongs 122 of carrier 120 and abuts shoulder 124 on carrier 120. Ring gear 140 preferably has an outer diameter equal to that of carrier 120 such that ring gear 140 is flush with carrier 140 when placed over prongs 122. Ring gear 140 has complementary teeth to planetary gears 130 and is preferably affixed to small peg box hole 7. Although ring gear 140 could have different numbers of teeth depending on the desired gear ratio, ring gear 140 preferably contains 24 teeth. Ring gear 140 may be externally tapered to fit small peg box hole 7.

The rightmost end of input shaft 160 contains cap 164. Cap 164 is cylindrical in shape with a diameter preferably equal to that of carrier 120. Input shaft 160 is of sufficient length to extend through carrier 120 and telescope within inner cavity 106. Input shaft 160 preferably has the same diameter as planetary gears 60 and the same number of teeth. Input shaft 160 has a notch 162 that is used to fix snap ring 110. Notch 162 is preferably positioned along input shaft 160 the distance of the length of carrier 120 from cap 164. Input shaft 160 is made of carbon steel hardened to resist distortion. Since load is born by the apexes or tips of teeth of planetary gears, the need for additional shafts is eliminated.

In use, the musician turns head 100 which in turn rotates input shaft 160. Rotation of input shaft 160 drives planetary gears 130 such that planetary gears 130 engage fixed ring gear 140. As planetary gears 130 are driven and engage fixed ring gear 140, prongs 122 are rotated which in turn rotates carrier 120 and the string is thus wound around it. Using this gear network, the musician is required to turn head 100 multiple times for carrier 120 to rotate fully once which allows for easier and more precise control of tuning.

A second alternative embodiment is illustrated in FIGS. 9–12. The second alternative embodiment does not require a bolt or a hole through the head and may be preferred for fine instruments in which the bolt would detract from a traditional appearance; in fact, the differences between the second alternative embodiment and a traditional wooden peg are not visible when the peg is installed on a stringed instrument.

Head 220 is the member of peg 210 that a user grasps between thumb and forefinger and rotates to change the pitch of a string. Head 220 is preferably shaped to look like a traditional tuning peg. Head 220 is preferably in the shape of a rounded rectangle with its major front and back surfaces concave. A shank 222 that is cylindrical in shape protrudes from head 220. Shank 222 is preferably tapered approximately the same as a traditional peg. Shank 222 has an integrally formed input shaft 226 extending coaxially therefrom. Shank 222 has a cavity 224 formed therein with a sufficient diameter to receive carrier 250 and ring gear 270. In order to maintain a relative positioning upon tuning, the outer surface of ring gear 270 engages the interior surface of shank 222 with sufficient friction to prevent further movement. Along the open end of shank 222 is a lip 230 that engages a shoulder 272 in ring gear 270 to secure ring gear 270 within shank 222. Although head 220 and shank 222 are preferably made of hard plastic, each could be made of any other dimensionally stable, durable material.

Figure 11:
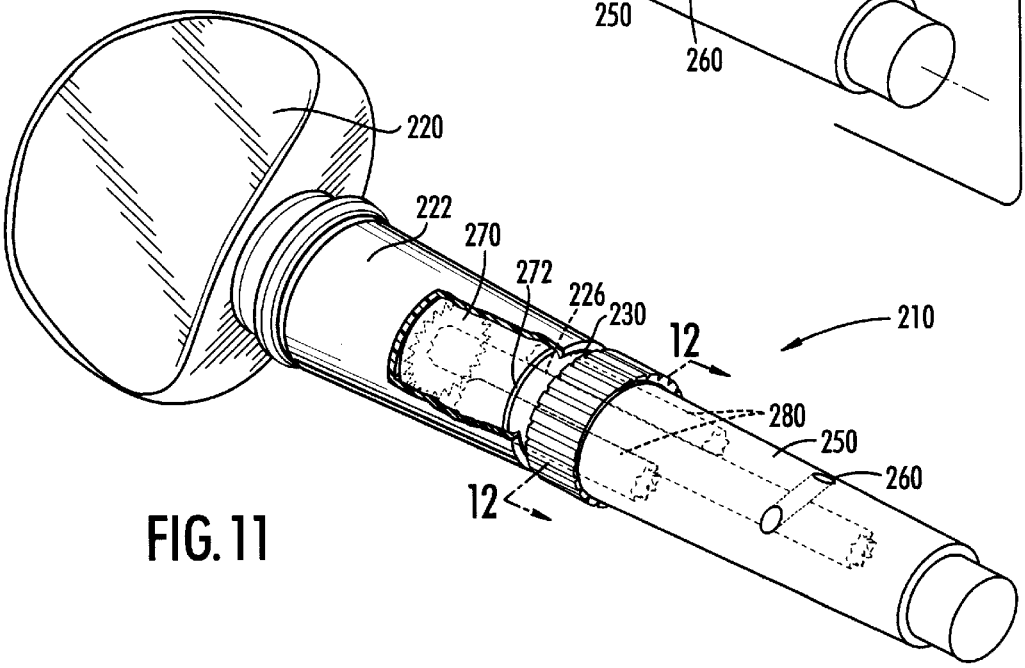
FIG. 11 is a cut-away perspective view of a tuning peg, according to a second alternative embodiment of the present invention.

Carrier 250 is encased by ring gear 270 and holds planetary gears 280. Carrier 250 is cylindrical in shape with a pair of spaced-apart prongs 252 protruding from the shoulder 254. As seen in FIG. 11, planetary gears 280 and input shaft 226 rests between prongs 252 on grooves 256. The distance between prongs 252 is preferably of sufficient size to accommodate planetary gears 280 and input shaft 226. Prongs 252 are offset from the cylindrical portion of carrier 250 a distance of shoulder 254. The offset distance is preferably sufficient so that the outer diameter of ring gear 270 is flush with conical portion of carrier 250 when encasing prongs 252. As illustrated in FIG. 12, the width of prongs 252 is preferably less than the combined width of the planetary gears 280 and input shaft 226 such that planetary gears 280 can engage ring gear 270. Carrier 250 also contains a string hole 260 for holding a string. The diameter of string hole 260 is preferably sufficient to accommodate the string of a stringed instrument 2 while string hole 260 is placed in carrier 250 so as to not obstruct any inner workings. Although carrier 250 is preferably made of a hardened plastic, any other material such as aluminum, steel, wood or any other material with sufficient rigidity to support rotation of planetary gears 280.

Planetary gears 280 rest on grooves 256 of prongs 252 and are driven by input shaft 226. Planetary gears 280 are preferably the same pitch diameter as input shaft 226 and have complementary teeth to both input shaft 226 and ring gear 270. Preferably, teeth on planetary gears 280 and input shaft 226 are helical in shape. In making a helical gear, an end of a preferably steel involute is fixed and the other end is rotated. Thereafter, the gear is fixed by a heat treatment. Although peg 20 preferably contains two planetary gears 280 with eight teeth, many different combinations of planetary gears with various numbers of teeth could be used depending upon the desired gear ratio. Although planetary gears 280 are preferably made of carbon steel, any material with sufficient rigidity such as hard plastic, brass, aluminum, could be used.

Ring gear 270 is carried by prongs 252 of carrier 250 and abuts shoulder 254 on carrier 50. Ring gear 270 preferably has a sufficient outer diameter so that the outer surface of ring gear 270 is flush with the outer surface of carrier 250 when placed over prongs 252. As illustrated best in FIG. 10 flanges 258 on prongs 252 secure ring gear 270 on carrier 250. In order to receive ring gear 270, prongs 252 are pressed together until ring gear 270 is fully accommodated by carrier 250. Once ring gear 270 is fully accommodated, prongs 252 resiliently open to an approximately parallel position. Ring gear 270 has a recess 274 to engage shoulder 254 so that the abutment between ring gear 270 and carrier 250 is flush. This arrangement carries the side load which would otherwise flex prongs 252 and cause gear misalignment. Ring gear 270 has complementary teeth to planetary gears 280 and is preferably fixed to small peg box hole 7. Although ring gear 270 could have different numbers of teeth depending on the desired gear ratio, ring gear 270 preferably contains 24 teeth. Additionally, since the load is born by apexes or tips of planetary gears, the need for additional shafts is eliminated.

In use, the musician turns head 220 which in turn rotates input shaft 226. As illustrated in FIG. 12, rotation of input shaft 226 drives planetary gears 280 which in turn engage fixed ring gear 270. As planetary gears 280 are driven and engage fixed ring gear 270, prongs 252 are rotated which in turn rotates carrier 250 and the string is thus wound around it. Using this gear network, the musician is required to turn head 220 multiple times for carrier to rotate fully once which allows for easier and more precise control of tuning.

A third alternative embodiment is illustrated in FIGS. 13–16. This alternative embodiment does not require bolt or hole through head and may also be preferred for fine instruments in which the bolt would detract from a traditional appearance. Also, in the third alternative embodiment the overall length of peg 310 may be adjusted telescopically to conform to the varying widths of peg box 4.

Figure 13:
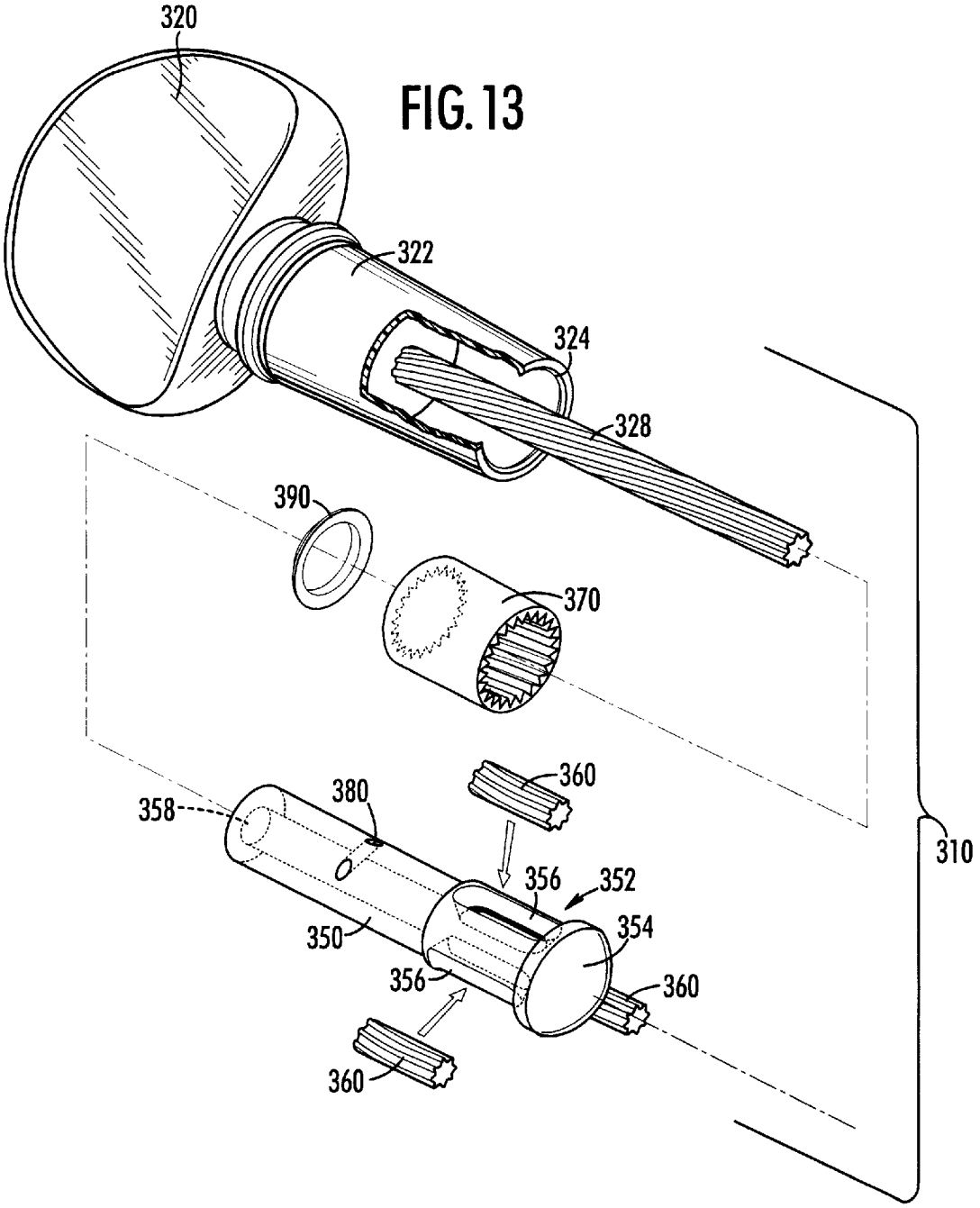
FIG. 13 is a cut-away, exploded, partially cut-away, perspective view of a tuning peg, according to a third alternative embodiment of the present invention.

Head 320 is the member of peg 310 that a user grasps between thumb and forefinger and rotates to change the pitch of a string. Head 320 is preferably shaped to look like a traditional tuning peg. Head 320 is in the shape of a rounded rectangle with its major front and back surfaces concave. A shank 322 that is cylindrical in shape protrudes from head 320. Shank 322 is preferably tapered approximately the same as the tapered diameter of peg box hole 6 to enable a friction fit. As seen in FIG. 13, shank 322 has an cavity 324. The diameter of cavity 324 is preferably of sufficient size to accommodate carrier 350. Shank 322 has an integrally formed input shaft 328 coaxially positioned within cavity 324. Although head 320 and shank 322 are preferably made of wood or hard plastic, each could be made of any other dimensionally stable, durable material.

Carrier 350 has an aperture 358 that longitudinally extends through to stop 354. Aperture 358 has a sufficient diameter to receive input shaft 328 so that input shaft 328 is freely rotatable within aperture 358. Carrier 350 also contains a string hole 380 for holding a string. String hole 380 is preferably offset so that a string will not interact with input shaft 328 or any other internal workings of carrier 350.

Figure 14:
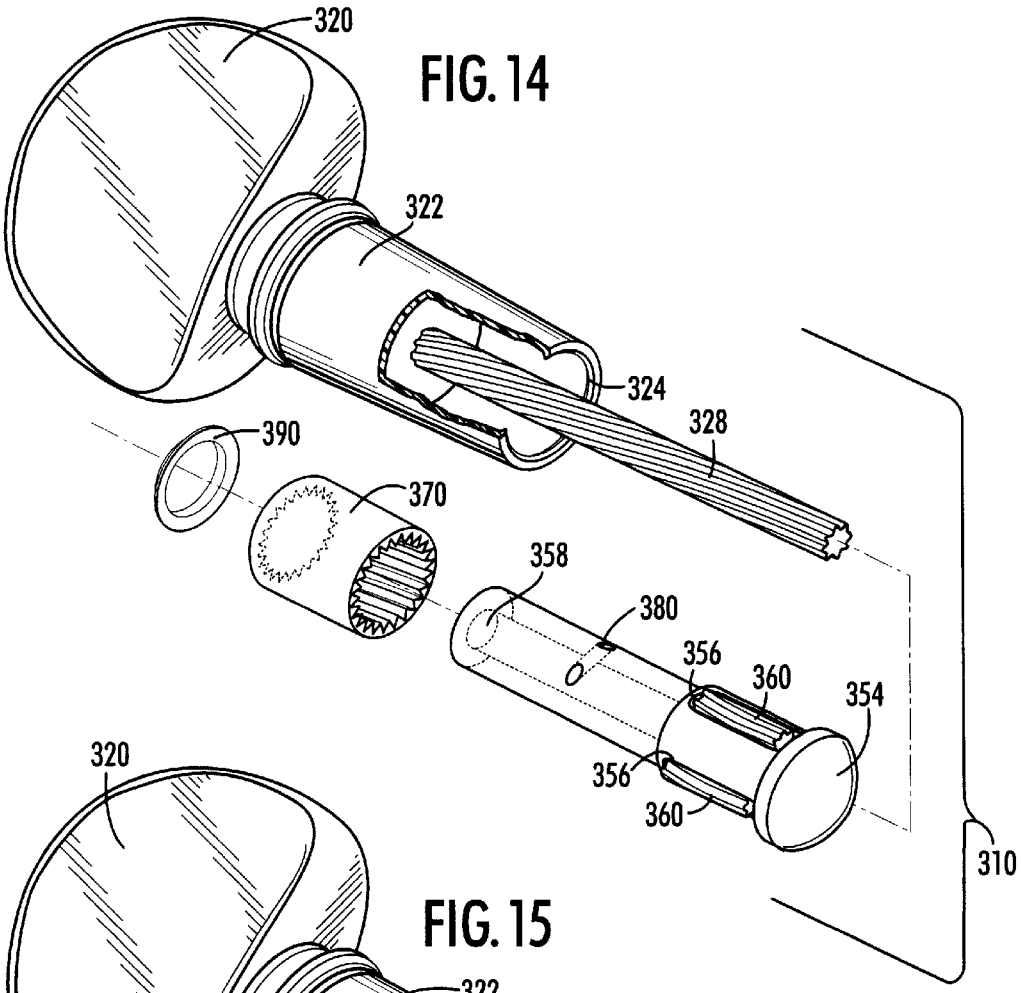
FIG. 14 is a cut-away, exploded, partially cut-away, perspective view of a tuning peg with the planetary gears carried by the carrier, according to a third alternative embodiment of the present invention.
Figure 15:
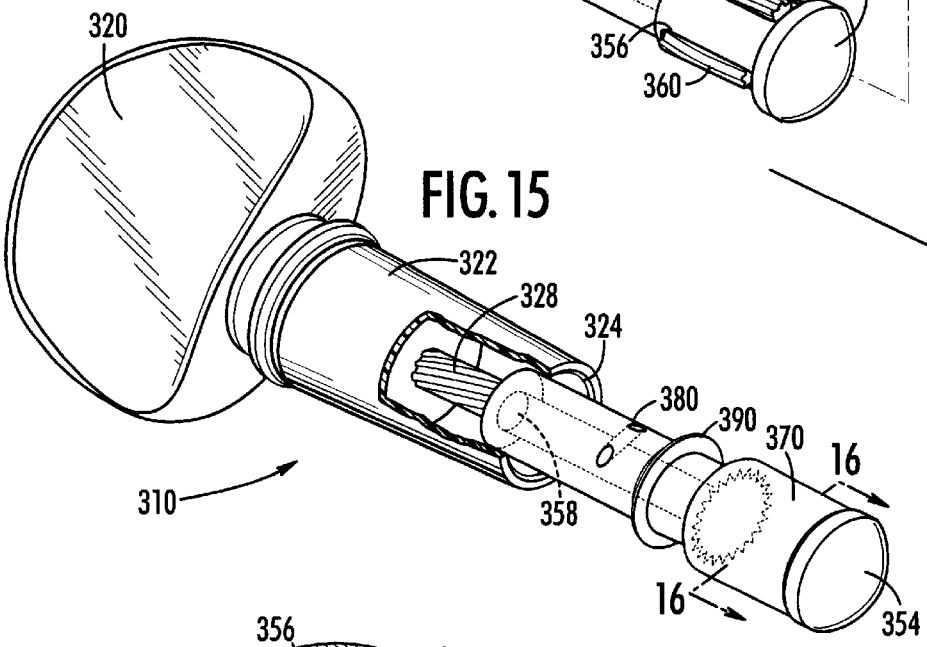
FIG. 15 is a cut-away perspective view of a tuning peg, according to a third alternative embodiment of the present invention.
Figure 16:
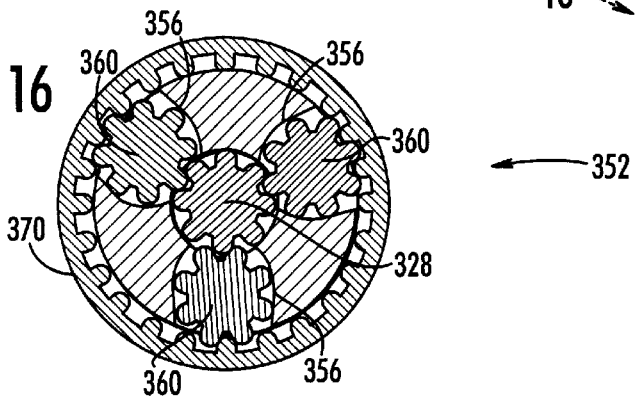
FIG. 16 is a front cross-sectional view along line 16—16 in FIG. 11 of a tuning peg, according to a third alternative embodiment of the present invention.

Carrier 350 has a chamber 352 with a plurality of slots 356 for carrying a plurality of planetary gears 360 as best illustrated in FIG. 14. Slots 356 have a sufficient dimension to receive planetary gears 360 such that planetary gears 360 engage both input shaft 328 and ring gear 370. Although carrier 350 is preferably made of brass, any other material such as aluminum, steel, hardened plastic or any other material with sufficient rigidity to support rotation of planetary gears 360.

Planetary gears 360 rest in slots 356 of carrier 350 and are driven by input shaft 328. Planetary gears 360 are preferably the same diameter as input shaft 328 and have complementary teeth to both input shaft 326 and ring gear 370. Although peg 310 preferably contains three planetary gears 360 with eight teeth, many different combinations of planetary gears 360 with various numbers of teeth could be used, depending upon the desired gear ratio. Preferably, teeth on planetary gears 360 and input shaft 328 are helical in shape. Although planetary gears 360 are preferably made of carbon steel, any material with sufficient rigidity such as hard plastic, brass, aluminum, could also be used. Additionally, since load is born by apexes or tips of teeth of planetary gears, the need for additional shafts is eliminated.

Ring gear 370 is rotatably carried by chamber 352 and abuts stop 354 on carrier 350. Ring gear 370 preferably has an outer diameter equal to that of stop 354 such that ring gear 370 is flush with stop 354 when placed over chamber 352. Chamber 352 preferably has approximately the same outer diameter as the inner diameter of ring gear 370. Ring gear 370 has complementary teeth to planetary gears 370 and is preferably affixed to small peg box hole 7. A retaining ring 390 is positioned adjacent to ring gear 370 and keeps ring gear 370 flush against stop 354. Although ring gear 370 could have different numbers of teeth depending on the desired gear ratio, ring gear 370 preferably contains 24 teeth. Ring gear 370 may be externally tapered to fit small peg box hole 7.

In use, the musician turns head 320 which in turn rotates input shaft 328. Rotation of input shaft 328 drives planetary gears 360 such that planetary gears 360 engage fixed ring gear 370. As planetary gears 360 are driven and engage fixed ring gear 370, carrier 350 rotates and the string is thus wound around it. Using this gear network, the musician is required to turn head 320 multiple times for carrier 350 to rotate fully once which allows for easier and more precise control of tuning.

It will be apparent to those skilled in the art that many changes and substitutions can be made to the preferred embodiment herein described without departing from the spirit and scope of the present invention.

What is claimed is:

1. A tuning peg comprising:

a first member having a hole therethrough capable of receiving a string, said first member having a pair of spaced-apart prongs;

a second member coupled to said first member;

a ring gear rotatably carried by said prongs of said first member;

a planetary gear carried between said prongs and within said ring gear wherein said planetary gear engages said ring gear so that said ring gear rotates in response to rotation of said planetary gear; and an input shaft coupled to said second member, said input shaft capable of engaging said planetary gear so that said planetary gear rotates in response to rotation of said input shaft.

2. A tuning peg for use with a musical instrument having a peg box, said tuning peg comprising:

a first member having a hole therethrough capable of receiving a string, said first member capable of being received by hole in a peg box and having a pair of spaced-apart prongs;

a second member coupled to said first member, said second member capable of being received by a hole in a peg box;

a ring gear rotatably carried by said prongs of said first member;

a planetary gear carried between said prongs and within said ring gear wherein said planetary gear engages said ring gear so that said ring gear rotates in response to rotation of said planetary gear; and an input shaft coupled to said second member, said input shaft capable of engaging said planetary gear so that said planetary gear rotates in response to rotation of said input shaft.

3. The tuning peg as recited in claim 2, wherein said planetary gear has helical teeth.

4. A stringed instrument comprising:

a body;

a peg box carried by said body, said peg box having a plurality of peg holes; and a plurality of tuning pegs wherein each tuning peg of said plurality of tuning pegs is carried within said peg holes of said peg box and has:

a first member having a hole therethrough capable of receiving a string, said first member having a pair of spaced-apart prongs, a second member coupled to said first member, a ring gear rotatably carried by said prongs of said first member, a planetary gear carried between said prongs and within said ring gear wherein said planetary gear engages said ring gear so that said ring gear rotates in response to rotation of said planetary gear, said planetary gear having helical teeth, and an input shaft coupled to said second member, said input shaft capable of engaging said planetary gear so that said planetary gear rotates in response to rotation of said input shaft.

5. The tuning peg as recited in claim 4, wherein said rotating means is a gear system, said gear system carried within by said first member and said second member so that said gear system is not visible when said plurality of tuning pegs is installed in said holes of said peg box.

6. The tuning peg as recited in claim 4, wherein said planetary gear has helical teeth.

* * * * *